US008525009B2

(12) United States Patent
Stevens et al.

(10) Patent No.: US 8,525,009 B2
(45) Date of Patent: Sep. 3, 2013

(54) MULTI-FUNCTION MUSICAL INSTRUMENT PEDAL CONTROLLER

(76) Inventors: Leigh Howard Stevens, Neptune, NJ (US); Roger Clerc, Oberweningen (CH)

( * ) Notice: Subject to any disclaimer, the term of this patent is extended or adjusted under 35 U.S.C. 154(b) by 287 days.

(21) Appl. No.: 12/823,003

(22) Filed: Jun. 24, 2010

(65) Prior Publication Data

US 2010/0326261 A1 Dec. 30, 2010

Related U.S. Application Data

(60) Provisional application No. 61/219,923, filed on Jun. 24, 2009.

(51) Int. Cl.
*G10D 13/08* (2006.01)

(52) U.S. Cl.
USPC ..... 84/402

(58) Field of Classification Search
USPC ..... 84/402–410, 453, 426, 72
See application file for complete search history.

(56) References Cited

U.S. PATENT DOCUMENTS

| | | | | |
|---|---|---|---|---|
| 1,807,057 | A | 5/1931 | Bowers | |
| 1,843,553 | A | 2/1932 | Gladstone | |
| 2,194,545 | A * | 3/1940 | Firestone | 84/403 |
| 2,556,342 | A | 6/1951 | Dickran | |
| 2,795,162 | A | 6/1957 | Eash | |
| 3,138,986 | A | 6/1964 | Musser | |
| 3,306,151 | A * | 2/1967 | Cser | 84/404 |
| 3,649,737 | A | 3/1972 | Jespersen | |
| 3,742,984 | A | 7/1973 | Wilkins et al. | |
| 3,807,345 | A | 4/1974 | Peterson | |
| 3,858,477 | A | 1/1975 | Kawakami | |
| 4,324,164 | A | 4/1982 | Monte et al. | |
| 4,570,525 | A | 2/1986 | Suzuki | |
| 4,619,178 | A | 10/1986 | Kondoh | |
| 4,913,023 | A | 4/1990 | Mizuguchi et al. | |
| 4,941,386 | A | 7/1990 | Stevens | |
| 5,189,236 | A | 2/1993 | Stevens | |
| 5,977,465 | A | 11/1999 | Piper | |
| 6,448,481 | B2 | 9/2002 | Machara et al. | |
| 7,012,203 | B2 | 3/2006 | Hanson | |
| 7,361,822 | B1 | 4/2008 | Hsieh | |
| 7,709,715 | B2 | 5/2010 | Stevens et al. | |
| 2002/0073824 | A1 | 6/2002 | Adams | |

OTHER PUBLICATIONS

"Vander Plas Percussion Discussion Board Web Pages," retrieved on Jan. 8, 2007, pp. 1-9.

Office Action dated Jan. 6, 2011 received in U.S. Appl. No. 12/612,050, 14 pgs.

Office Action dated Sep. 17, 2010 received in U.S. Appl. No. 12/687,448, 17 pgs.

* cited by examiner

*Primary Examiner* — Kimberly Lockett
(74) *Attorney, Agent, or Firm* — Grossman, Tucker, Perreault & Pfleger, PLLC

(57) ABSTRACT

A multi-function pedal controller may be used with a musical instrument, such as a keyboard percussion instrument, to allow control of both vibrato and damper functions. The multi-function pedal controller may control damper functions with a first range of motion and vibrato functions with a second range of motion, thereby facilitating intuitive control of both functions by the instrumentalist.

24 Claims, 8 Drawing Sheets

MULTI-FUNCTION MUSICAL INSTRUMENT PEDAL CONTROLLER

CROSS-REFERENCE TO RELATED APPLICATIONS

The present application claims the benefit of U.S. Provisional Patent Application Ser. No. 61/219,923, filed on Jun. 24, 2009, which is fully incorporated herein by reference.

TECHNICAL FIELD

The present invention relates to musical instruments and more particularly, to keyboard percussion instruments with dampening and vibrato features.

BACKGROUND INFORMATION

A category of musical instruments known as keyboard percussion instruments includes marimbas, vibraphones, xylophones and glockenspiels. Referring to FIGS. 1 and 2, a keyboard percussion instrument 10 generally includes keys known as tone bars 14 that are supported on support rails 22 such that the tone bars 14 are allowed to ring freely when struck by a mallet (not shown). The tone bars 14 and support rails 22 may form a tone bar rail assembly (sometimes referred to as the "harp"). The keyboard percussion instrument may also include a frame 20 that supports the tone bar rail assembly. The keyboard percussion instrument 10 may further include resonators 15 mounted below the tone bars 14.

The keyboard percussion instrument 10 may also include a dampening system including a damper 30 to dampen the tone bars 14 and control the ringing. The dampening system may include a pedal 34 for user actuation of the dampening. Examples of such keyboard percussion instruments are described in greater detail in U.S. Pat. Nos. 6,245,978 and 5,977,465 and in U.S. Patent Application Publication No. 2008/0105105, all of which are fully incorporated herein by reference.

The damper pedal 34 may operate similarly to the sustain pedal of a piano. When the damper pedal is in a neutral position, one or more damper pads are in contact with the tone bars. By depressing the damper pedal, the instrumentalist disengages the damper pad(s) from the tone bars, allowing them to decay naturally unless the damper pedal is released and the damper pad(s) re-engage. One example of a dampening system for use with a keyboard percussion instrument is described in greater detail in U.S. Provisional Patent Application Ser. No. 61/111,161 and U.S. patent application Ser. No. 12/612,050, published as U.S. Patent Application Publication No. 2010/0107852, which are fully incorporated herein by reference.

The vibraphone usually includes an apparatus to provide vibrato effects. One such apparatus includes an array of disks, mounted on an axle inside the tops of the resonating tubes. These disks are spun by an electric motor and alternately partially block, then partially open the tops of the tubes as the motor spins, producing the traditional steady-state vibrato sound. In these traditional vibraphones, the speed of the vibrato may be controlled by adjusting the rate of the electric motor controlling the rotational speed of the discs, but with almost no possibility for the player to control the vibrato speed to match the underlying rhythm of the music or to adjust the speed on an instantaneous basis to match the expressive needs of an individual note, chord or moment in the music.

More recently, alternative methods for producing the vibrato effect have been introduced which allow the instrumentalist to control the vibrato volume modulation effect with manual controls rather than adjusting the speed of a motor. Examples of such methods are described in greater detail in U.S. Patent Application Publication No. 2008/0314227, now U.S. Pat. No. 7,732,691, which is fully incorporated herein by reference. This human powered, manually controlled vibrato feature may be adjusted during the performance on a measure by measure, beat by beat basis.

Providing adequate control over both the dampening and vibrato effects of a vibraphone without interfering with the instrumentalist's hand and finger technique presents unique challenges. Providing the desired level of manual control over both of these features independently is particularly difficult because the hands are usually carrying multiple mallets when playing the vibraphone, for example.

BRIEF DESCRIPTION OF THE DRAWINGS

These and other features and advantages will be better understood by reading the following detailed description, taken together with the drawings wherein.

DETAILED DESCRIPTION

A multi-function pedal controller, consistent with embodiments described herein, may be used with a musical instrument, such as a keyboard percussion instrument, to allow control of both vibrato and damper functions. The multi-function pedal controller may control damper functions with a first range of motion and vibrato functions with a second range of motion, thereby facilitating intuitive control of both functions by the instrumentalist. Although the exemplary embodiment uses first and second ranges of motion in a generally vertical direction to control vibrato and damper functions, additional ranges of motion may be used to control other parameters and the ranges of motion may be in other directions (e.g., horizontal).

FIGS. 3 and 4A-4C show one embodiment of a multi-function pedal controller 300. The pedal controller 300 generally includes a damper pedal portion 320 and a vibrato pedal portion 340 pivotably coupled to the damper pedal portion 320. In the illustrated embodiment, the damper pedal portion 320 has a flat "T" shape and the wide end of the damper pedal portion 320 provides access to the pedal portion 320 from different positions as the instrumentalist moves to reach different sections of the playing surface. The vibrato pedal portion 340 is narrower than the damper pedal portion 320. Although the illustrated embodiment shows a particular shape and configuration of the pedal portions 320, 340, other shapes and configurations are possible.

Figure 6:
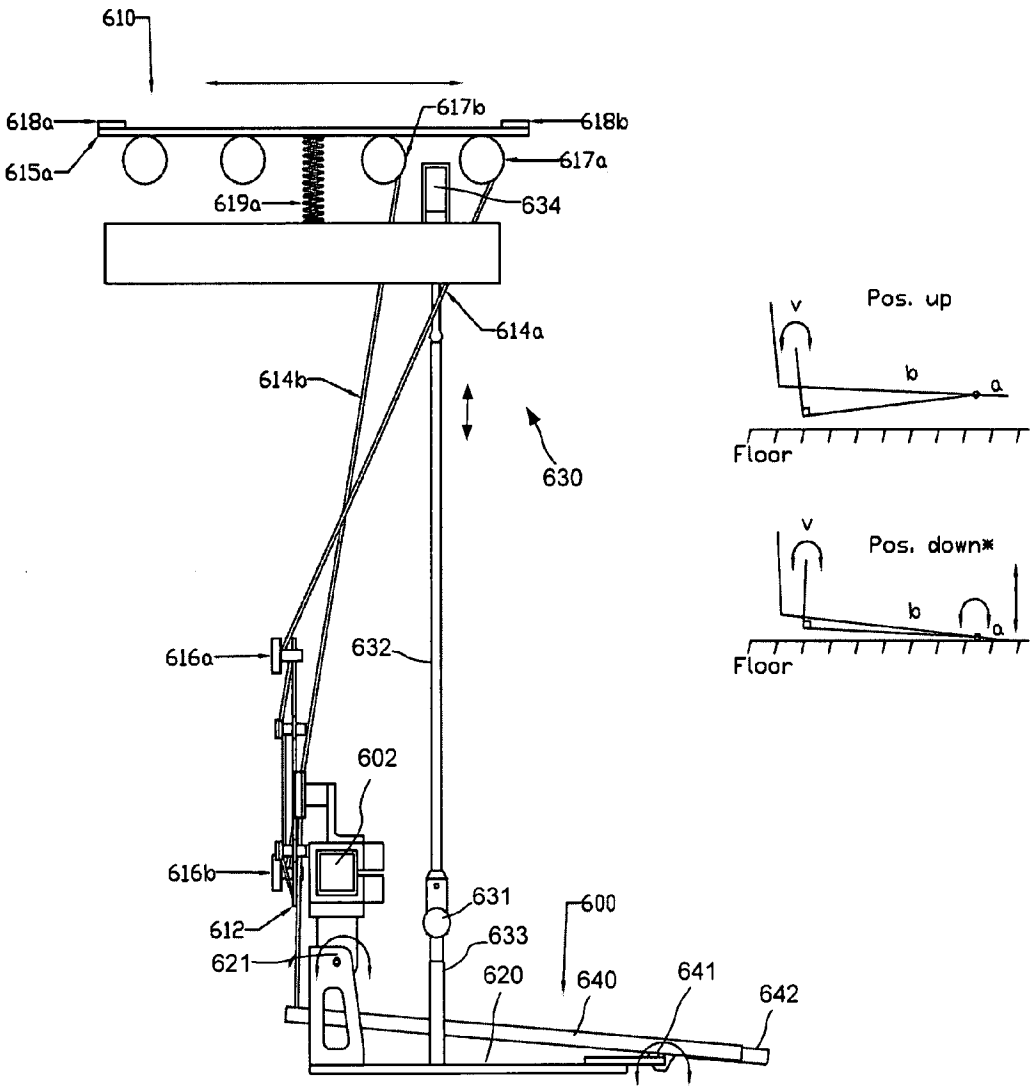
FIG. 6 is a schematic side view of another embodiment of a multi-function pedal controller coupled to a dampening mechanism and a vibrato mechanism.

The damper pedal portion 320 is coupled to a damper mechanism (e.g., as shown in FIG. 6) and has a first range of motion that causes actuation of the damper mechanism. One example of a damper mechanism that may be used is described in greater detail in U.S. Provisional Patent Application Ser. No. 61/111,161 and U.S. patent application Ser. No. 12/612,050, published as U.S. Patent Application Publication No. 2010/0107852, which are fully incorporated herein by reference. In the illustrated embodiment, the damper pedal portion 320 is pivotable about a pivot point 321 such that the first range of motion is generally in the direction of arrow 422 (see FIG. 4A). Although the pivot point 321 is shown on a support portion 322 of the damper pedal portion 320, other configurations are possible. Other ranges of motion may also be possible, for example, the damper pedal portion 320 could move in a generally vertical direction without pivoting.

The damper pedal portion 320 may be coupled to the damper mechanism via a damper pull member 332, such as a rod, cable, or other coupling member. The damper pull member 332 may extend through a slot 344 in the vibrato pedal portion 340. A ball pivot 333 may be coupled between the damper pull member 332 and the damper pedal portion 320 to allow for rotation when the damper pedal portion 320 is depressed. A ball pivot may also be coupled in other locations, such as at the top of the damper pull member 332. An adjustment mechanism (not shown), such as a turnbuckle, may be coupled to the damper pull member 332 to adjust the position of the damper pedal portion 320 (e.g., relative to the floor).

The vibrato pedal portion 340 is coupled to a vibrato mechanism (e.g., shown in FIG. 6) and has a second range of motion that causes actuation of the vibrato mechanism. One example of a vibrato mechanism that may be used is a manually operated vibrato mechanism, such as the type described in greater detail below and in U.S. Patent Application Publication No. 2008/0314227, now U.S. Pat. No. 7,732,691, which is fully incorporated herein by reference. In the illustrated embodiment, the vibrato pedal portion 340 is pivotable relative to the damper pedal portion 320 about a pivot point 341 such that the second range of motion is generally in the direction of arrow 442 (see FIG. 4B). Although the pivot point 341 is shown at the end of the damper pedal portion 320, other pivot locations on the damper pedal portion are possible.

A proximal end 342 of the vibrato pedal portion 340 extends beyond the pivot point 341 to contact a fixed surface (e.g., the floor 410) toward the end of the first range of motion and the beginning of the second range of motion. The proximal end 342 of the vibrato pedal portion 340 can be adjustable or extendable, for example, using an adjustable "tab," so that the beginning of the second range of motion may be adjusted by the player to start sooner or later. When the proximal end 342 is lengthened, the vibrato may be engaged sooner, and when shortened, the vibrato may be engaged later in the downward range of pedal motion. The vibrato pedal portion 340 may be coupled to the vibrato mechanism via an actuator 312, such as a cable, line, linkage, and/or other coupling member. This allows the range of motion of the vibrato effect to be adjusted. The longer the second range of motion is, for example, the greater the range of motion of the shutters/plates over the resonator tubes and/or the more revolutions the disks spin in one direction before reversing direction (i.e., if used with the traditional disks).

Although the illustrated embodiment shows a vibrato pedal portion 340 pivotably coupled to the damper pedal portion 320, other mechanisms may be used to effect a second (or additional) range of motion beyond the motion of the damper pedal portion 320. A spring-loaded plunger or pin may be located beneath the damper pedal portion 320 such that the plunger or pin contacts the floor (or other surface) at the end of the first range of motion. Further motion would then cause the plunger or pin to move (e.g., against a compression spring) and push up against a rod (e.g., similar to the vibrato pedal portion 340) and/or pull down on a cable or line (e.g., similar to the actuator 312). Other mechanisms for actuating the vibrato mechanism (or other instrument parameter) in response to a second or additional range of motion may also be used.

Although the illustrated embodiment shows an actuator 312 to control a manually operated vibrato mechanism, other embodiments may include a vibrato actuator used to control an electric vibrato control (such as a motor speed control). For example, the actuator 312 may control a potentiometer connected to a vibrato motor. The second half of the range of motion could control the speed of the motor, which changes the vibrato. Thus, the multi-function pedal controller described herein may also be adapted to control motorized vibrato produced by rotating pulsar disks.

Figure 4A:
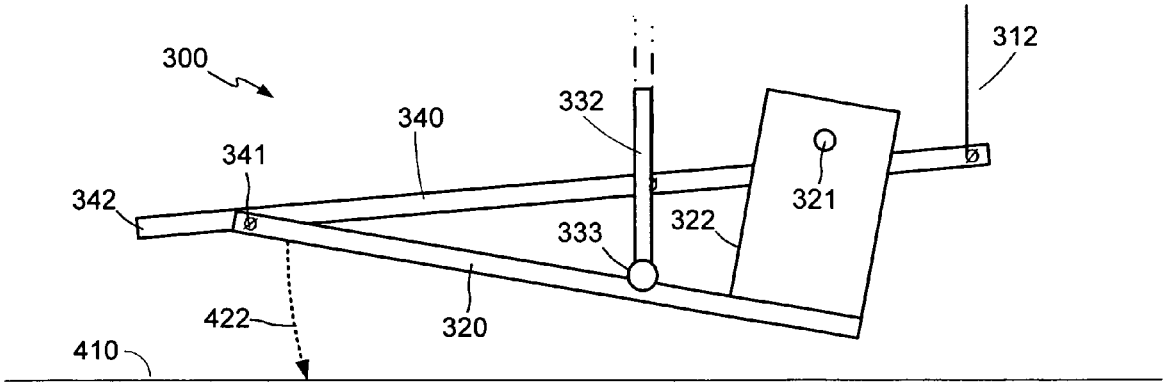
FIGS. 4A-4C are side views of one embodiment of a multi-function pedal controller, shown in three positions.
Figure 4B:
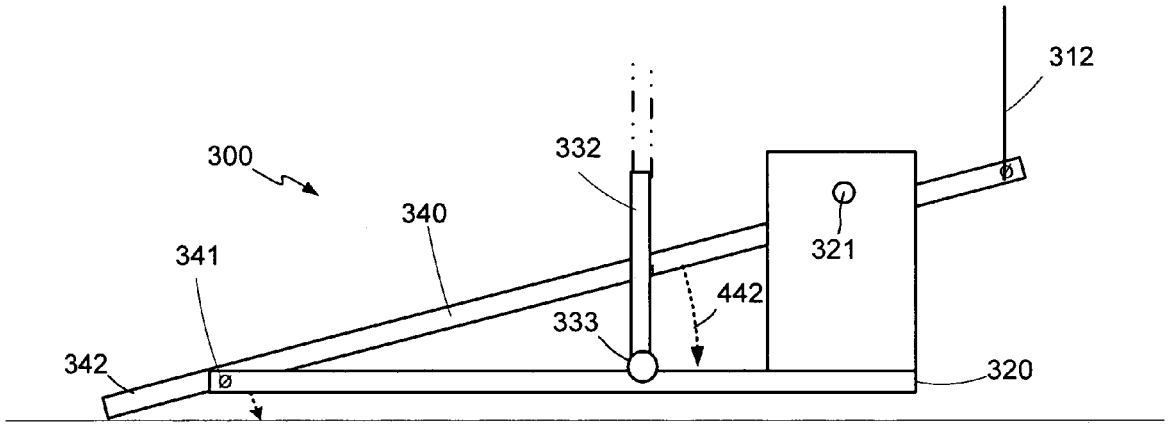

During an exemplary operation, the pedal controller 300 moves through the first range of motion to actuate the damper mechanism and then through the second range of motion to actuate the vibrato mechanism. In the uppermost (neutral) position, the proximal end of the damper pedal portion 320 may rest an inch or two above the floor 410 (FIG. 4A). As the instrumentalist depresses this damper pedal portion 320 toward the floor (FIG. 4B), damper pull member 332 exerts a force on the damper mechanism, causing the damper pads to disengage from the tone bars, allowing the tone bars to ring without impediment. As the damper pedal portion is further depressed to a mid position, the proximal end 342 of the vibrato pedal portion 340 touches the floor before the damper pedal portion 320 touches the floor (FIG. 4B).

Figure 4C:
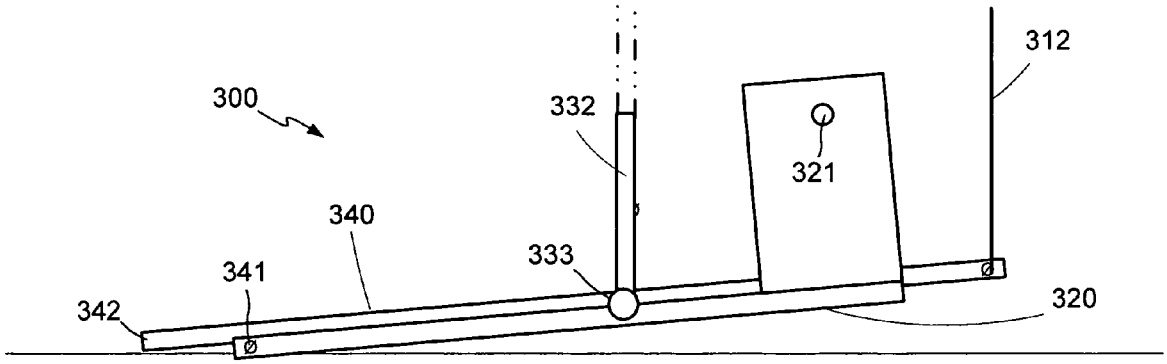

The instrumentalist may continue to press down on the damper pedal portion 320 to actuate the vibrato mechanism. As the instrumentalist pushes the damper pedal portion 320 below the mid position, as shown in FIG. 4B, the floor exerts an upward force against the proximal end 342 of the vibrato pedal portion 340 causing the vibrato pedal portion to pivot at the pivot point 341. This pivoting motion forces the distal end of the vibrato pedal portion 340 to move downward toward the distal end of the damper pedal portion 320. The proximal end of the damper pedal portion 320 may be further depressed to the floor, causing the distal end of the vibrato pedal portion 340 to be lowered to the down position (FIG. 4C). The vibrato actuator (e.g., line 312) is engaged and the vibrato mechanism is controlled as the damper pedal portion 320 is variably moved between the mid and down position and the vibrato pedal portion 340 moves within the second range of motion.

This embodiment of the multi-function pedal controller allows the instrumentalist to manipulate the damper control in a manner similar to a traditional, single function damper pedal while also having control over vibrato or other effects. Because volume of a dampened tone bar decays very rapidly, the instrumentalist may choose not to control the vibrato or other effect until the damper is disengaged, as vibrato is more noticeable to the listener when applied to a sustaining, undampened tone bar. Once the damper is disengaged, the instrumentalist may control the vibrato by continuing to depress his foot on the damper pedal portion 320 or directly on the vibrato pedal portion 340.

Figure 5:
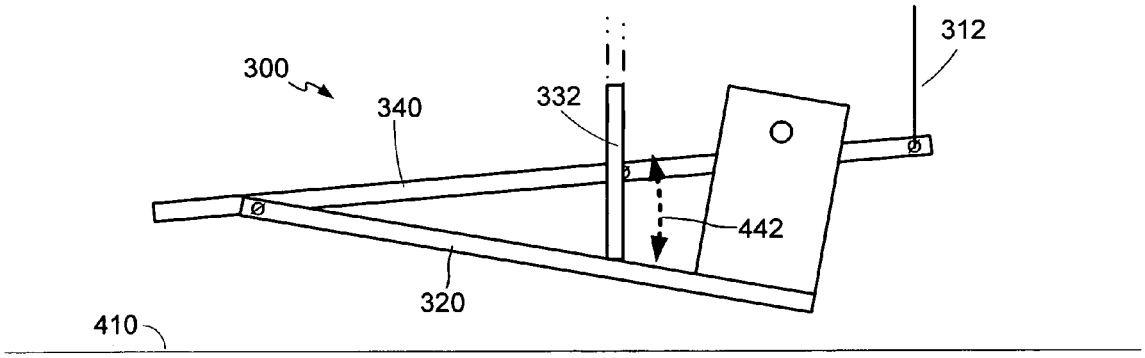
FIG. 5 is a side view of one embodiment of a multi-function pedal controller indicating the motion of a vibrato pedal portion when a damper pedal portion is in the neutral position.

As shown in FIG. 5, the instrumentalist may also control the vibrato function of the instrument independently of the damper control by directly manipulating the vibrato pedal portion 340. For instance, the instrumentalist could control the vibrato function while the damper is still engaged by manipulating the vibrato pedal portion 340 independently of the damper pedal portion 320. This can be accomplished by placing the foot directly on the vibrato pedal portion 340, rather than pressing down on the damper pedal portion 320. A brake system (not shown) may also be used to hold the damper in the open position (down) so that the player does not have to overcome the resistance of the damper springs when using the vibrato feature and the vibrato may be operated more freely.

Figure 7:
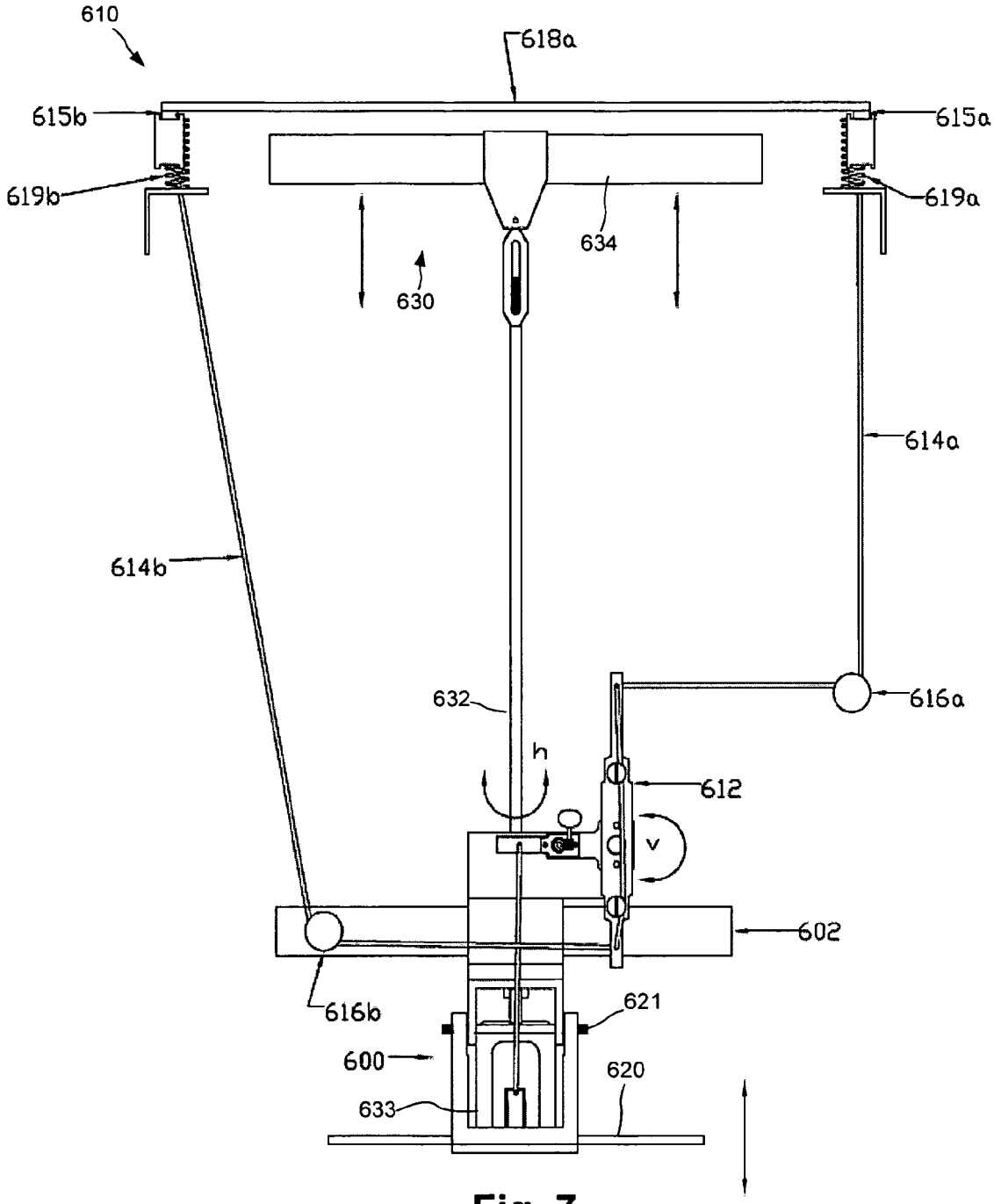
FIG. 7 is a schematic front view of the multi-function pedal controller shown in FIG. 6.
Figure 8:
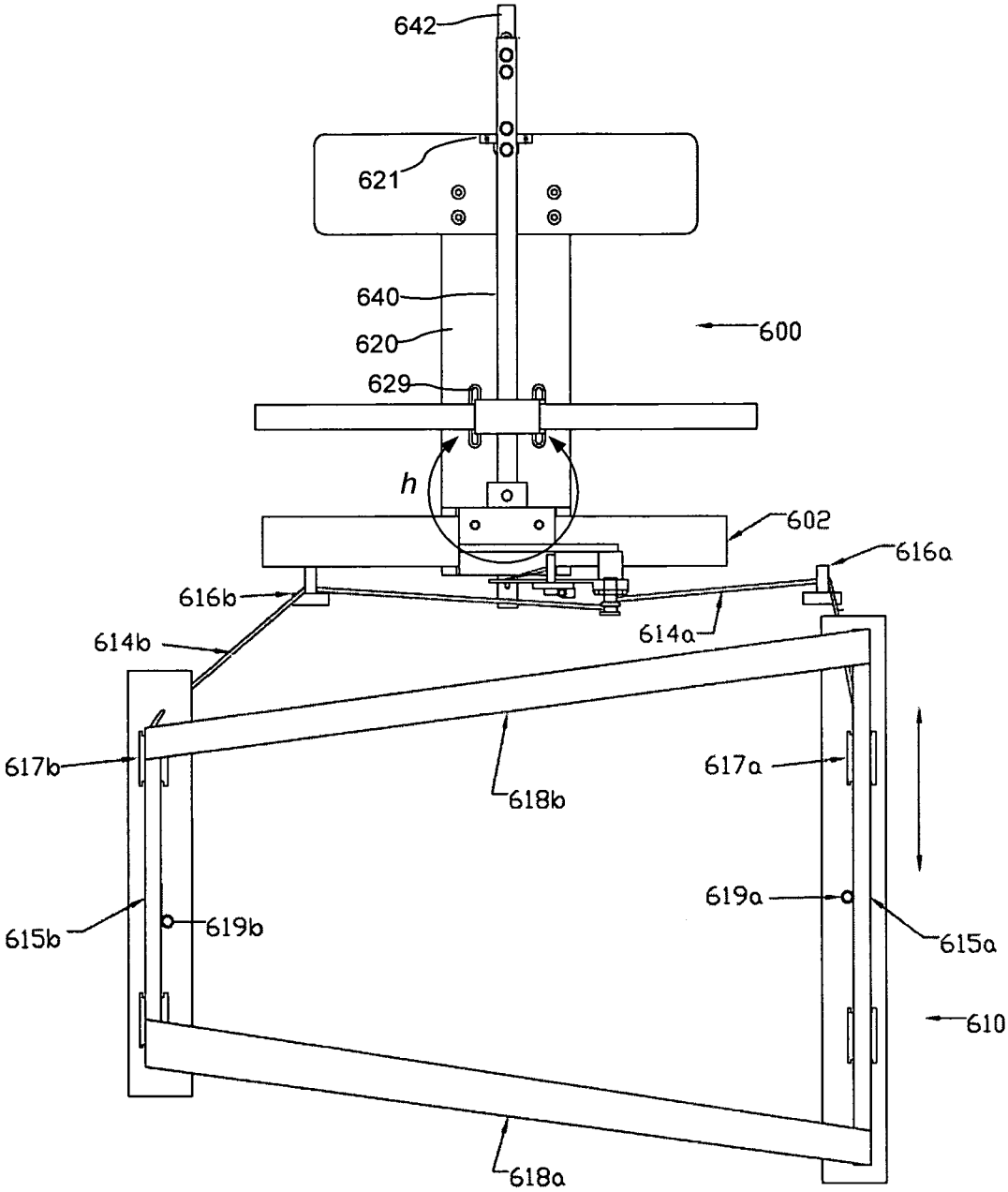
FIG. 8 is a schematic top view of the multi-function pedal controller shown in FIG. 6.

Referring to FIGS. 6-8, one embodiment of a multi-function pedal controller 600 coupled to a manually operated vibrato mechanism 610 and a damper mechanism 630 is shown and described in greater detail. The pedal controller 600 may be mounted to a cross beam 602 such that the pedal controller 600 is pivotable vertically (in the direction v) to provide the first range of motion, for example, as described above. The pedal controller 600 may also be pivotable horizontally (in the direction h) to allow the instrumentalist to change the orientation of the pedal controller 600 toward the position of the instrumentalist, thereby facilitating access and control. Similarly, the pedal controller may be moved longitudinally toward the treble or bass end of the instrument as the instrumentalist desires. Such longitudinal movement may require an adjustment to the vibrato actuator to maintain appropriate tension with the vibrato controller.

The pedal controller 600 may include a damper pedal portion 620 pivotably supported at pivot point 621 and a vibrato pedal portion 640 pivotably coupled to the damper pedal portion 320 at pivot point 641 as described above. The vibrato pedal portion 640 may include an extendable portion 642 that allows the length of the vibrato pedal portion 640 to be adjusted to adjust the beginning of the second range of motion as described above. In this embodiment, the vibrato pedal portion 640 is substantially narrower than the damper pedal portion 620.

The damper pedal portion 620 may be coupled to a damper pull member 632 for causing movement of a damper bar 634. Thus, when the damper pedal portion 620 is pushed toward the floor, the pull member 632 causes the damper bar 634 to move downward and disengages the dampening mechanism 630. Although the exemplary embodiment shows a simplified dampening mechanism 630, other mechanisms may also be used. Another example of a dampening mechanism may include a damper bar mounted on damper supports extending from pivot arms such that a pull member causes the pivot arms to pivot and disengage the damper bar, for example, as described in U.S. Patent Application No. 2010/0107852.

The damper pedal portion 620 may be coupled to the damper pull member 632 via a coupling member 633 that extends around the vibrato pedal portion 640. The damper pedal portion 620 may include one or more slots 629 (shown in FIG. 8) that allow the coupling member 633 to be coupled in different locations on the damper pedal portion 620, thereby allowing the position of the pull member 632 to be adjusted. Adjusting the pull member 632 closer to or further from the pivot point 621 changes the feel/resistance of the pedal response and amount of damper pad travel relative to the pedal travel. An adjustment mechanism 631, such as a turnbuckle, may also be coupled between the damper pedal portion 620 and the damper pull member 632 to adjust the length of the damper pull member 632, which allows the position of the damper pedal portion 620 to be adjusted relative to the floor.

The vibrato pedal portion 640 may be coupled to a linkage 612, which is coupled to one or more cables or lines 614*a*, 614*b* for causing movement of the manually operated vibrato mechanism 610 responsive to movement of the vibrato pedal portion 640. The cables or lines 614*a*, 614*b* are routed around one or more cable guides 616*a*, 616*b*. In an embodiment, one of the cables or lines 614*a* may control the vibrato mechanism 610 at a high end of the instrument and another one of the cables or lines 614*b* may control the vibrato mechanism 610 at a low end of the instrument. Due to the smaller diameter of the resonator tubes in the high range, the high end of the vibrato mechanism needs to move only about ⅓ the distance of the low end. The cables or lines 614*a*, 614*b* may be made of a relatively low friction material such as polyethylene terephthalate (PET), also known as DACRON, to allow faster operation. The cables or lines 614*a*, 614*b* may also be wire, fishing line, string, or other suitable materials.

The cable guides 616*a*, 616*b* may be knobs that engage the cable so that the cable bends around the cable guide, thereby redirecting the cable along a different path. The cable guides 616*a*, 616*b* may be made of a polished chrome-plated material to minimize friction of the cables or lines 614*a*, 614*b* and allow for faster operation. In an embodiment, only two cable guides 616*a*, 616*b* may be used, resulting in only two friction points and further minimizing friction. The cable guides 616*a*, 616*b* may also include pulleys or other structures or devices capable of allowing the cables or lines 614*a*, 614*b* to move relatively smoothly. The cable guides 616*a*, 616*b* may also be adjustable (e.g., by sliding in a horizontal or vertical direction) to adjust the direction and/or tension of the cables or lines 614*a*, 614*b*.

Figure 1:
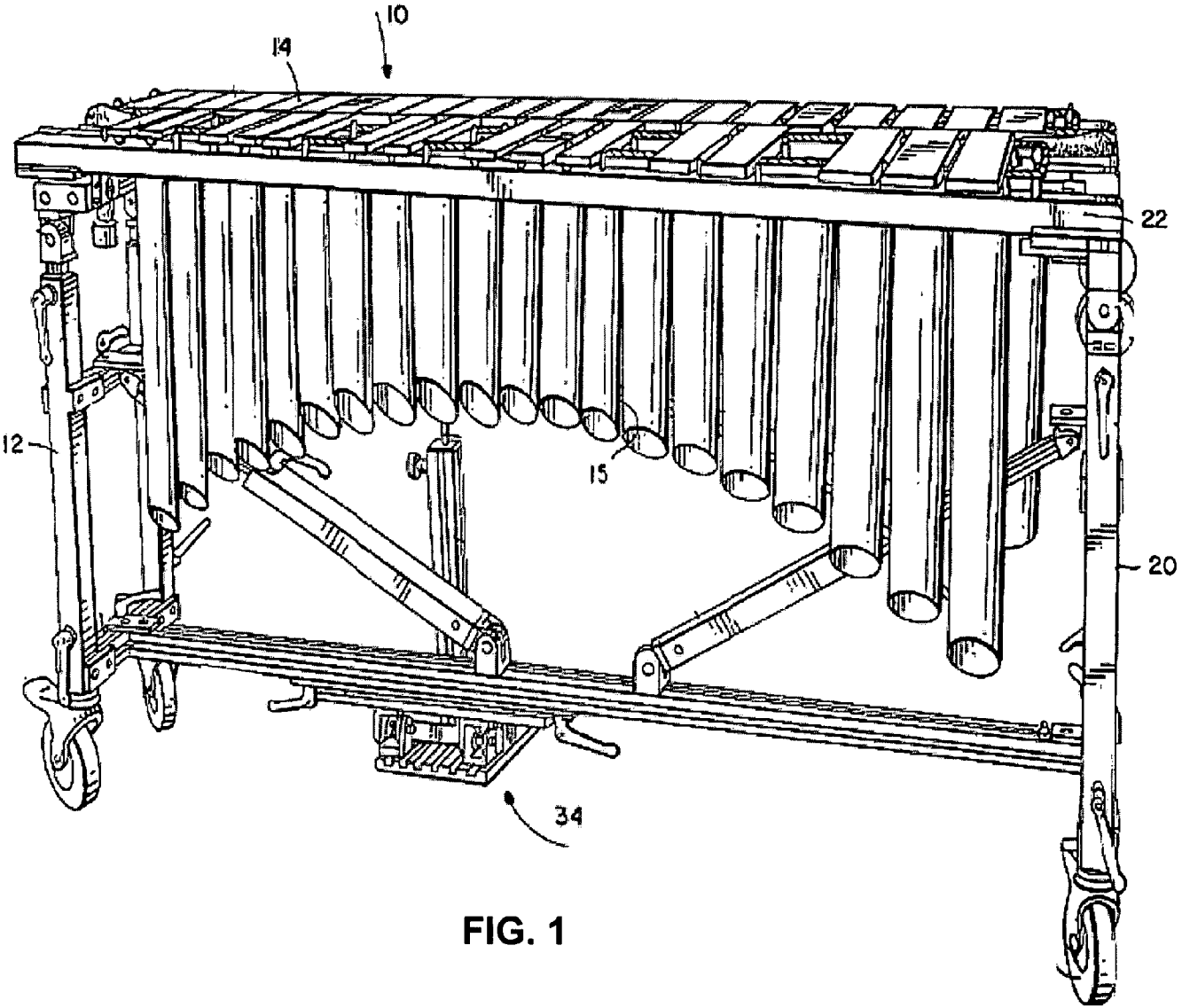
FIG. 1 is a perspective view of a keyboard percussion instrument.
Figure 2:
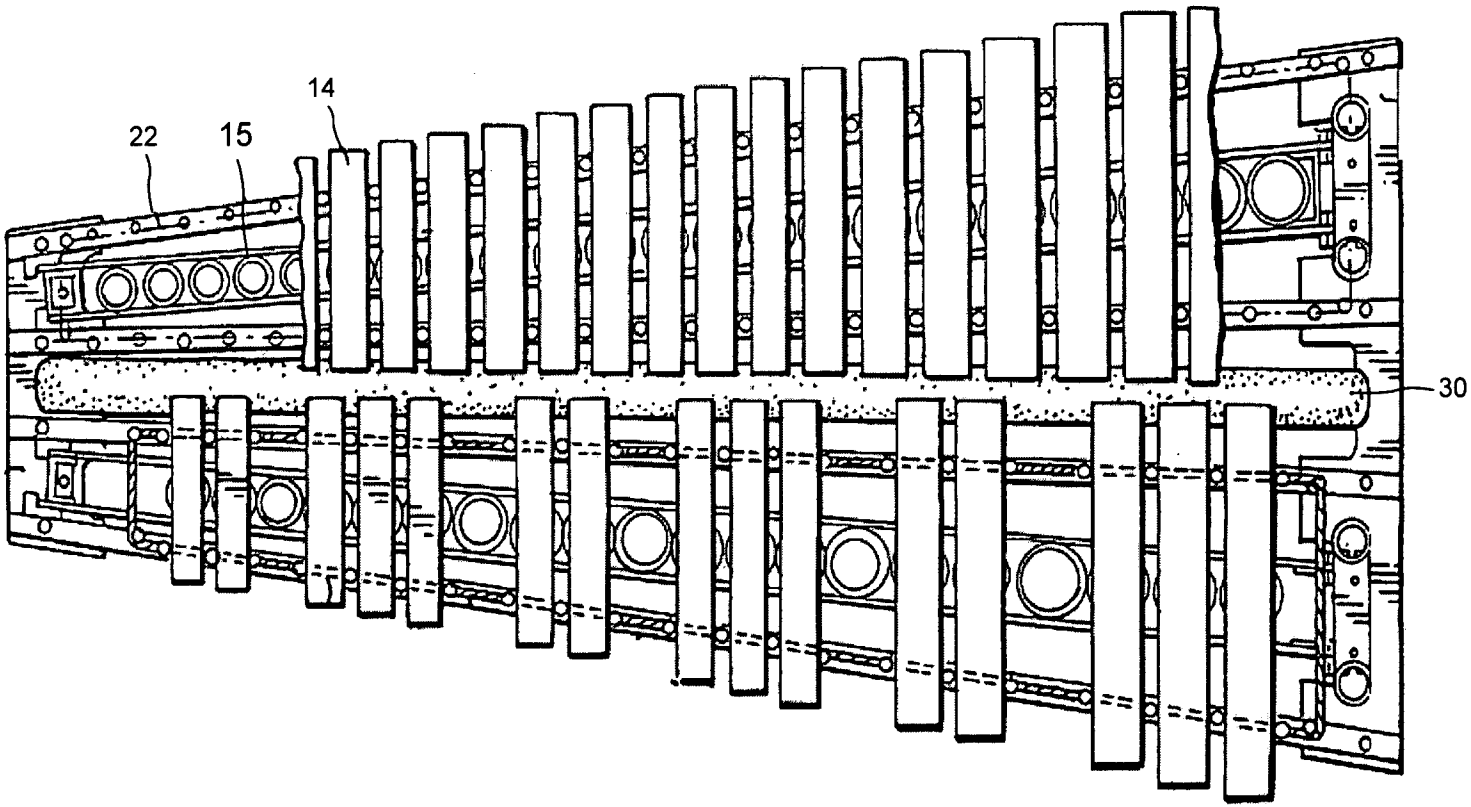
FIG. 2 is a top view of a keyboard percussion instrument.
Figure 3:
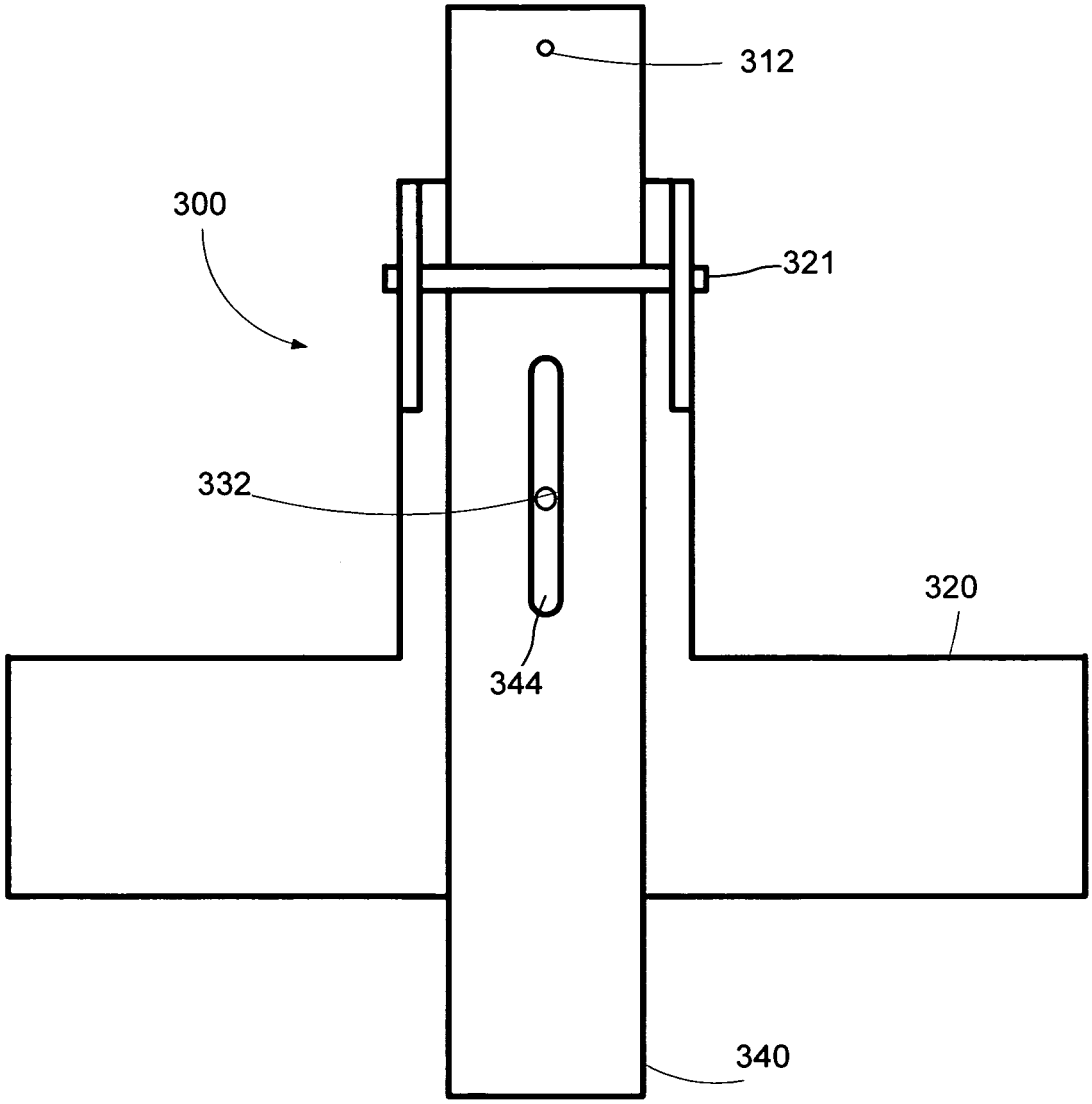
FIG. 3 is a top view of one embodiment of a multi-function pedal controller for a musical instrument.

The vibrato mechanism 610 may include resonator covers that move relative to one or more resonators (e.g. resonators 15 shown in FIG. 1) in an instrument to cause the vibrato effects. In the illustrated embodiment, the resonator covers are plates or shutters 618*a*, 618*b* that move laterally relative to one end the resonators and between the resonators and tone bars. The plates or shutters 618*a*, 618*b* may be coupled to rolling supports 615*a*, 615*b* that ride on rollers 617*a*, 617*b* and are coupled to springs 619*a*, 619*b*, for example, as described in U.S. Patent Application Publication No. 2008/0314227. One shutter 618*a* may be movable relative to the resonators associated with natural keys and the other shutter 618*b* may be movable relative to the resonators associated with sharp keys. In other embodiments, separate shutters may be provided and controllable for resonators associated with the high end and the low end, respectively In other embodiments, the resonator covers may be pulsar fans or disks (not shown) that rotate at or within one end of the resonator tubes. In a conventional motorized vibrato system including motor controlled fans or disks, for example, the motor may be removed and the cables or lines 614*a*, 614*b* may be coupled to the axles that rotate the fans or disks such that the cables or lines 614*a*, 614*b* cause the rotation in response to movement of the pedal controller 600.

In further embodiments, a multi-function pedal controller may use multiple ranges of motion to control other parameters (acoustic or electronic) of a musical instrument including, but not limited to, pitch modulation, portamento, sostenuto, or filter control (e.g., "wah-wah"). For an electric guitar, for example, a multi-function pedal controller with 3 ranges of motion could be used to control 3 parameters such as chorus, wah-wah, and then brightness or some other parameter. For a vibraphone, a multi-function pedal controller with 3 ranges of motion could be used to control the damper and the vibrato on separate sections (e.g., high and low) of the instrument, such as first ⅓ motion damper, next ⅓ motion vibrato only on top, and last ⅓ motion vibrato in both registers. In a vibraphone using motor controlled pulsar disks, for example, the axle connecting all the pulsar disks in the middle of the instrument could be split and coupled separately to 2 motors that are actuated by different ranges of motion or a clutch may be used to add vibrato to a lower section when the pedal is fully depressed.

Although the illustrated embodiments used different vertical ranges of motion to control different parameters, other directions of motion may also be used instead of or in addition to the vertical ranges of motion. For example, a side to side motion of the pedal, or in and out motion could be added to control other musical parameters. When a multi-function pedal controller is used to control a motor operated vibrato mechanism, for example, the side to side motion or in and out motion may control a potentiometer/resistor in the speed system of the motor.

Consistent with an embodiment, a multi-function pedal controller for a musical instrument includes a damper pedal portion having a distal end and a proximal end and a vibrato pedal portion having a distal end and a proximal end. The vibrato pedal portion is pivotably coupled to the damper pedal portion at a pivot point proximate the proximal end of the damper pedal portion such that the proximal end of the vibrato pedal portion extends beyond the pivot point. The damper pedal portion is configured to have a first range of motion such that movement of the damper pedal portion in the first range of motion actuates a damper mechanism. The vibrato pedal portion is configured to have a second range of motion pivoting relative to the damper pedal portion such that movement of the vibrato pedal portion in the second range of motion actuates a vibrato mechanism.

Consistent with another embodiment, a musical instrument includes a plurality of tone bars configured to produce musical notes, at least one damper mechanism configured to contact and dampen at least a some of the tone bars, at least one vibrato mechanism configured to produce vibrato effects; and a multi-function pedal controller configured to move in at least first and second ranges of motion. The first range of motion controls the vibrato mechanism and the second range of motion controls the damper mechanism.

Consistent with a further embodiment, a method of controlling sound parameters of a musical instrument includes: engaging a pedal controller to move in a first range of motion and cause a damping mechanism to disengage from tone bars in the musical instrument; and engaging the pedal controller to move in a second range of motion and cause a vibrato mechanism to create a vibrato effect in the musical instrument.

Consistent with yet another embodiment, a multi-function pedal controller for a musical instrument includes a first pedal portion having a distal end and a proximal end and at least a second pedal portion having a distal end and a proximal end. The second pedal portion is pivotably coupled to the first pedal portion proximate the proximal end of the first pedal portion such that the proximal end of the second pedal portion extends beyond the pivot point. The first pedal portion is configured to have a first range of motion such that movement of the first pedal portion in the first range of motion actuates a first instrument parameter. The second pedal portion is configured to have a second range of motion pivoting relative to the first pedal portion such that movement of the second pedal portion in the second range of motion actuates a second instrument parameter.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A multi-function pedal controller for a musical instrument, comprising:

a damper pedal portion having a distal end and a proximal end, wherein the damper pedal portion is configured to have a first range of motion such that movement of the damper pedal portion in the first range of motion actuates a damper mechanism; and a vibrato pedal portion having a distal end and a proximal end, wherein the vibrato pedal portion is pivotably coupled to the damper pedal portion at a pivot point proximate the proximal end of the damper pedal portion such that the proximal end of the vibrato pedal portion extends beyond the pivot point, and wherein the vibrato pedal portion is configured to have a second range of motion pivoting relative to the damper pedal portion such that movement of the vibrato pedal portion in the second range of motion actuates a vibrato mechanism.

2. The multi-function pedal controller of claim 1 further comprising a damper pull member coupled to the damper pedal portion, wherein movement of the damper pedal portion in the first range of motion causes the damper pull member to actuate the damper mechanism.

3. The multi-function pedal controller of claim 2 further comprising an adjustment mechanism attached to the damper pull member facilitating adjustment of a length of the damper pull member.

4. The multi-function pedal controller of claim 2 wherein the damper pedal portion pivots about a pivot point to provide the first range of motion, and further comprising an adjustable coupling member coupling the damper pull member to the damper pedal portion, the adjustable coupling member being configured to adjust a position of the damper pull member relative to the damper pivot point.

5. The multi-function pedal controller of claim 1 further comprising a vibrato actuator coupled to the vibrato pedal portion, wherein movement of the vibrato pedal portion in the second range of motion causes the vibrato actuator to actuate the vibrato mechanism.

6. The multi-function pedal controller of claim 4 wherein the vibrato actuator comprises at least one actuator line.

7. The multi-function pedal controller of claim 1 wherein the vibrato pedal portion has an adjustable length to adjust a beginning of the second range of motion.

8. The multi-function pedal controller of claim 1 wherein the damper pedal portion is pivotably mounted proximate the distal end of the damper pedal portion such that the damper pedal portion pivots in the first range of motion.

9. The multi-function pedal controller of claim 1 wherein the proximal end of the vibrato pedal portion contacts a fixed surface at the end of the first range of motion and at the beginning of the second range of motion.

10. A musical instrument comprising:

a plurality of tone bars configured to produce musical notes;

at least one damper mechanism configured to contact and dampen at least a some of the tone bars;

at least one vibrato mechanism configured to produce vibrato effects; and a multi-function pedal controller configured to move in at least first and second ranges of motion, the first range of motion controlling the vibrato mechanism and the second range of motion controlling the damper mechanism.

11. The musical instrument of claim 10 further comprising resonators located proximate the tone bars, and wherein the vibrato mechanism comprises at least one resonator cover configured to cover at least a portion of at least one of the resonators, and a vibrato actuator mechanism configured to cause the at least one resonator cover to move relative to the at least one of the resonators.

12. The musical instrument of claim 11 wherein the resonator cover includes at least one shutter that moves laterally relative to the resonators.

13. The musical instrument of claim 11 wherein the at least one resonator cover includes at least one shutter configured to move relative to resonators for natural keys and at least one shutter configured to move relative to resonators for sharp keys, wherein a range of lateral movement of the high end shutter is less than a range of lateral movement of the low end shutter.

14. The musical instrument of claim 11 wherein the at least one resonator cover includes pulsar fans that rotate within or near an end of respective ones of the resonators.

15. The musical instrument of claim 11 wherein the vibrato actuator mechanism includes at least one actuator line extending from the multi-function pedal controller to the at least one resonator cover such that movement of the multi-function pedal controller in the second range of motion causes the at least one resonator cover to move.

16. The musical instrument of claim 15 wherein the vibrato actuator mechanism further includes guides that guide the at least one actuator line from the multi-function pedal controller to the at least one resonator cover.

17. The musical instrument of claim 10 wherein the multi-function pedal controller is pivotable horizontally.

18. The musical instrument of claim 10 wherein the multi-function pedal controller is pivotable vertically to provide at least the first range of motion.

19. The musical instrument of claim 10 wherein the damper mechanism comprises:

at least one damper bar configured to contact the tone bars; and a damper actuator mechanism configured to cause the damper bar to move out of and in to contact with the tone bars.

20. The musical instrument of claim 10 wherein the multi-function pedal controller comprises:

a damper pedal portion having a distal end and a proximal end, wherein the damper pedal portion is configured to have the first range of motion such that movement of the damper pedal portion in the first range of motion actuates the damper mechanism; and a vibrato pedal portion having a distal end and a proximal end, wherein the vibrato pedal portion is pivotably coupled to the damper pedal portion proximate the proximal end of the damper pedal portion such that the proximal end of the vibrato pedal portion extends beyond the pivot point, and wherein the vibrato pedal portion is configured to have the second range of motion pivoting relative to the damper pedal portion such that movement of the vibrato pedal portion in the second range of motion actuates the vibrato mechanism.

21. The musical instrument of claim 10 further comprising resonators located proximate the tone bars, and wherein the vibrato mechanism comprises resonator covers that rotate relative to the resonator and at least one motor for rotating the resonator covers, wherein the motor is controlled by the multi-function pedal controller.

22. The musical instrument of claim 10 wherein the multi-function pedal controller is configured to move in a third range of motion, and wherein the second and third range of motion provide different ranges of vibrato control.

23. A method of controlling sound parameters of a musical instrument comprising:

engaging a pedal controller to move in a first range of motion and cause a damping mechanism to disengage from tone bars in the musical instrument; and engaging the pedal controller to move in a second range of motion and cause a vibrato mechanism to create a vibrato effect in the musical instrument.

24. A multi-function pedal controller for a musical instrument, comprising;

a first pedal portion having a distal end and a proximal end, wherein the first pedal portion is configured to have a first range of motion such that movement of the first pedal portion in the first range of motion actuates a first instrument parameter; and at least a second pedal portion having a distal end and a proximal end, wherein the second pedal portion is pivotably coupled to the first pedal portion proximate the proximal end of the first pedal portion such that the proximal end of the second pedal portion extends beyond the pivot point, and wherein the second pedal portion is configured to have a second range of motion pivoting relative to the first pedal portion such that movement of the second pedal portion in the second range of motion actuates a second instrument parameter.

* * * * *